US005083928A

United States Patent [19]

Aikens et al.

[11] Patent Number: 5,083,928

[45] Date of Patent: Jan. 28, 1992

[54] ELECTRICAL PIN TIPS

[75] Inventors: Paul W. Aikens, Etters; Thomas B. Lyons, Harrisburg, both of Pa.

[73] Assignee: E. I. Du Pont de Nemours and Company, Wilmington, Del.

[21] Appl. No.: 691,653

[22] Filed: Apr. 25, 1991

[51] Int. Cl.[5] ..... H01R 13/02; H01R 9/09

[52] U.S. Cl. ..... 439/82; 439/78; 439/751; 439/886

[58] Field of Search ..... 439/78, 81, 82, 751, 439/884, 886, 889

[56] References Cited

U.S. PATENT DOCUMENTS

| | | | |
|---|---|---|---|
| 4,443,053 | 4/1984 | Astbury | 339/221 |
| 4,606,589 | 8/1986 | Elsbree, Jr. et al. | 439/82 |
| 4,721,484 | 1/1988 | Sakamoto et al. | 439/842 |
| 4,776,807 | 10/1988 | Triner et al. | 439/82 |
| 4,983,134 | 1/1991 | Baldyrou | 439/884 |
| 5,002,507 | 3/1991 | Sitzler | 439/751 |
| 5,015,207 | 5/1991 | Koepke | 439/886 |

FOREIGN PATENT DOCUMENTS 2239580 9/1990 Japan .

OTHER PUBLICATIONS

Leith W. Lebo, "Swaging Instead of Stamping for Contact Pins", Connection Technology, Apr. 1989, pp. 25 and 26.

*Primary Examiner*—Paula A. Bradley
*Attorney, Agent, or Firm*—John E. Griffiths

[57] ABSTRACT

The present invention relates to electrical terminal pins for use in interconnecting electrical leads, plated through holes in printed circuit boards and/or connector contacts and, in particular, to electrical terminal pin tips on insertion ends of the pins.

17 Claims, 8 Drawing Sheets

ELECTRICAL PIN TIPS

BACKGROUND OF THE INVENTION

1. Field of the Invention.

This invention relates to electrical terminal pins for use in interconnecting electrical leads, plated through holes in printed circuit boards and/or connector contacts and, in particular, to electrical terminal pin tips on insertion ends of the pins.

2. Description of Related Art.

It is well known in the connector art to use electrical pins to interconnect electrical leads, plated through holes in printed circuit boards and/or connector contacts. Such pins typically have square or round cross sections perpendicular to their longitudinal axes.

The pins are made from an electrically conductive material, such as copper, brass, phosphor bronze, beryllium copper or the like. It is further known to plate or coat the pins with a conductive layer, such as tin, nickel, pladium, gold, silver or a suitable alloy. Pins are plated in order to apply a layer on a pin core that does not oxidize as much as the material of the core. Less oxidation at an electrical connection improves electrical performance. Pins are made with a core material different than the plating material in order to reduce the cost of the pin and/or to make the pin more rigid than if the pin was entirely made out of the plating material.

It is well known in the art to make pin tips with flat tapered sides to facilitate alignment with and/or insertion into a plated through hole or a mating contact. For instance, FIG. 1 shows an enlarged perspective view of an electrical terminal pin tip 2 of a prior art electrical terminal pin 4 with a portion broken away to show a cross section 6 of the pin 4. The pin 4 comprises an electrically conductive inner core 8 plated with an electrically conductive outer layer 10. FIG. 2 is an end view of the prior art electrical pin tip 2 of FIG. 1.

Referring to FIGS. 1 and 2, the pin tip 2 has a pair of opposed flat swaged plated sides 12 that taper or slope towards a longitudinal axis of the pin 4 as the pin 4 approaches its longitundinal end. The pin tip 2 further has a pair of opposed flat trimmed non-plated sides 14 that taper or slope towards the longitudinal axis of the pin 4 as the pin 4 approaches its longitundinal end. The opposed flat trimmed non-plated sides 14 are jointed at the longitudinal end by a trimmed non-plated curved or cylindrical surface 16. When this tip 2 is inserted into a plated through hole or a female contact, the plated through hole or the female contact can slide against the non-plated tapered sides 14 causing some of the core material to be transferred onto the plated through hole or the female contact. Multiple insertions and withdrawals of the pin 4 into plated through holes or mating female contacts increase the probability of rubbing some of the core material off the non-plated sides 14 onto the plated through holes or mating female contacts. This transferred core material can ultimately be dragged or positioned between the pin plating 10 and the plated through hole or the female contact. Depending on the materials used for the core 8 and the plating or layer 10, this may increase the oxidation rate of the connection between the pin 4 and the plated through hole or the female contact, compared to a connection directly between pin plating 10 and the plated through hole or the female contact.

Other pin tips are shaped by trimming which removes plating material from trimmed flat sides. Then one or more additional process step is performed to plate the trimmed sides. Although this ensures that all exterior sides and surfaces of the pin tip are plated, it adds time and cost to the manufacturing process.

It is typical to simultaneously insert a plurality of pins, such as, mounted in a connector housing, into a mating set of plated through holes or female terminals. The insertion force required increases with the number of pins being inserted and can be significant. Tapered flat sides on pin tips reduce the inserion force required. However, it is desireable to further reduce the longitudinal insertion force without reducing the lateral retention force applied on the pin by the plated through holes or female terminals.

It is desirable to provide a pin tip that satifies the above described needs and overcomes the above described disadvantages of the prior art.

SUMMARY OF THE INVENTION

This invention relates to an electrical terminal pin tip for inserting into an electrical female terminal or a plated-through hole of a printed circuit board. The pin tip comprises an electrically conductive layer and an electrically conductive core with an axis of symmetry. The core has a non-plated substantially flat end having at least one edge. The core further has at least one curved side substantially plated with the conductive layer. Each one of the sides extends from a corresponding one of the flat end edges away from the axis of symmetry.

BRIEF DESCRIPTION OF THE DRAWINGS

The invention can be more fully understood from the following detailed description thereof in connection with accompanying drawings described as follows.

DESCRIPTION OF THE PREFERRED EMBODIMENT(S)

Figure 1:
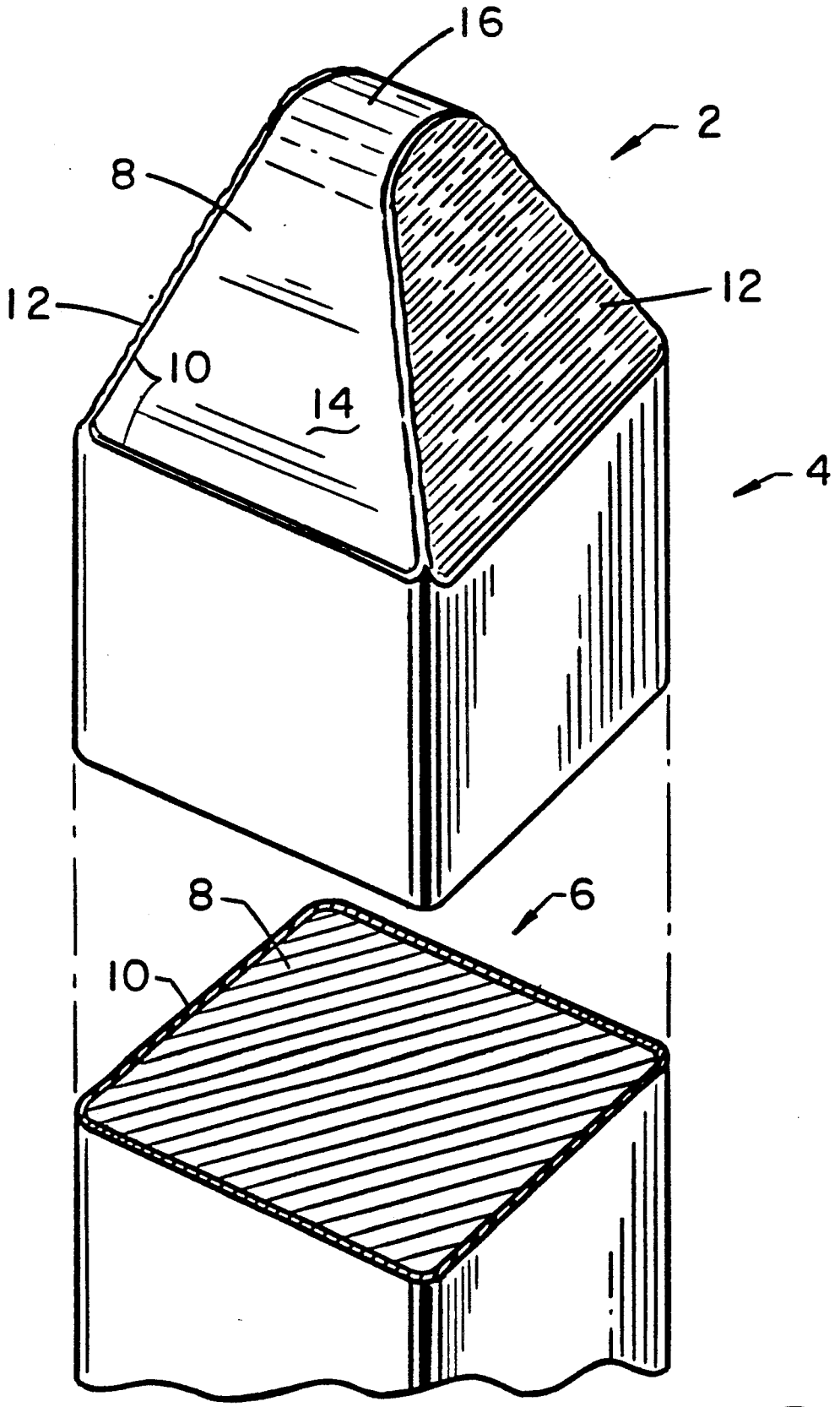
FIG. 1 PRIOR ART
FIG. 1 is an enlarged perspective view of an electrical terminal pin tip of a prior art electrical terminal pin with a portion broken away to show a cross section of the pin.

Throughout the following detailed description, similar reference characters refer to similar elements in all figures of the drawings.

Figure 3:
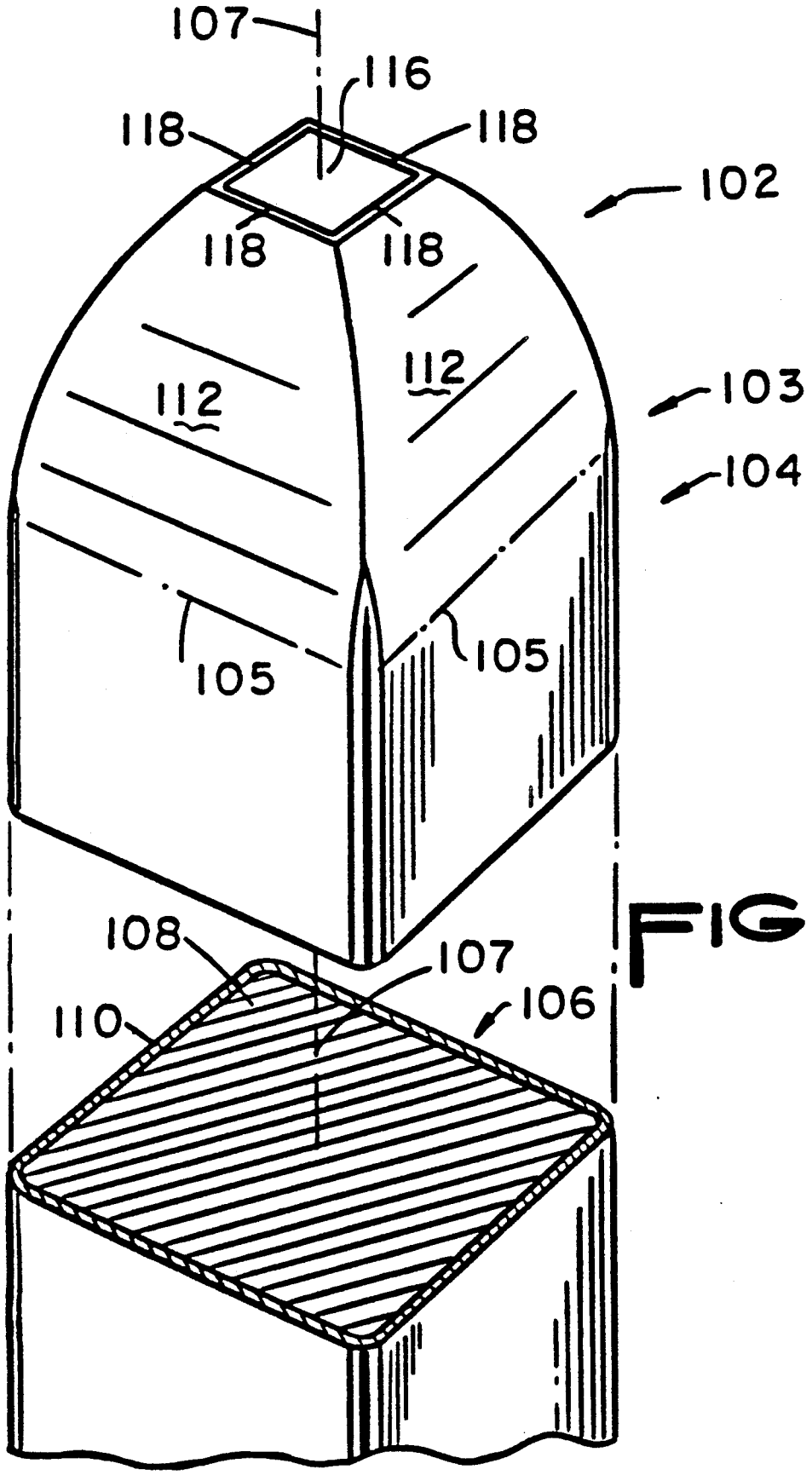
FIG. 3 is an enlarged perspective view of a first embodiment of an electrical terminal pin tip on an end portion of an electrical terminal pin with a portion broken away to show a cross section of the pin in accordance with the present invention.
Figure 4:
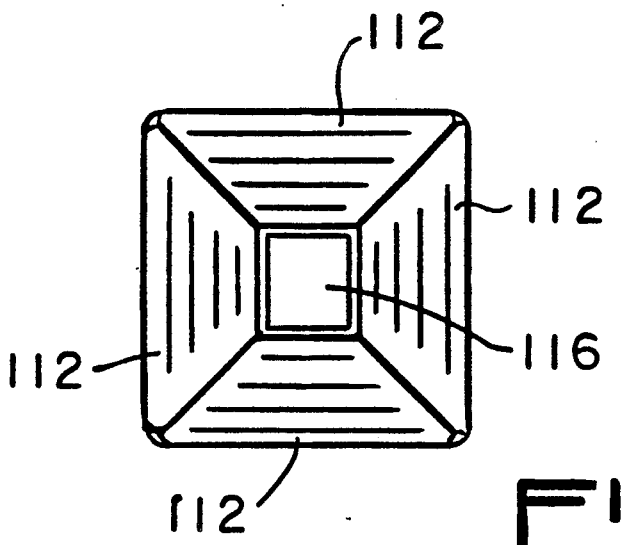
FIG. 4 is a end view of the electrical terminal pin tip of FIG. 3.
Figure 5:
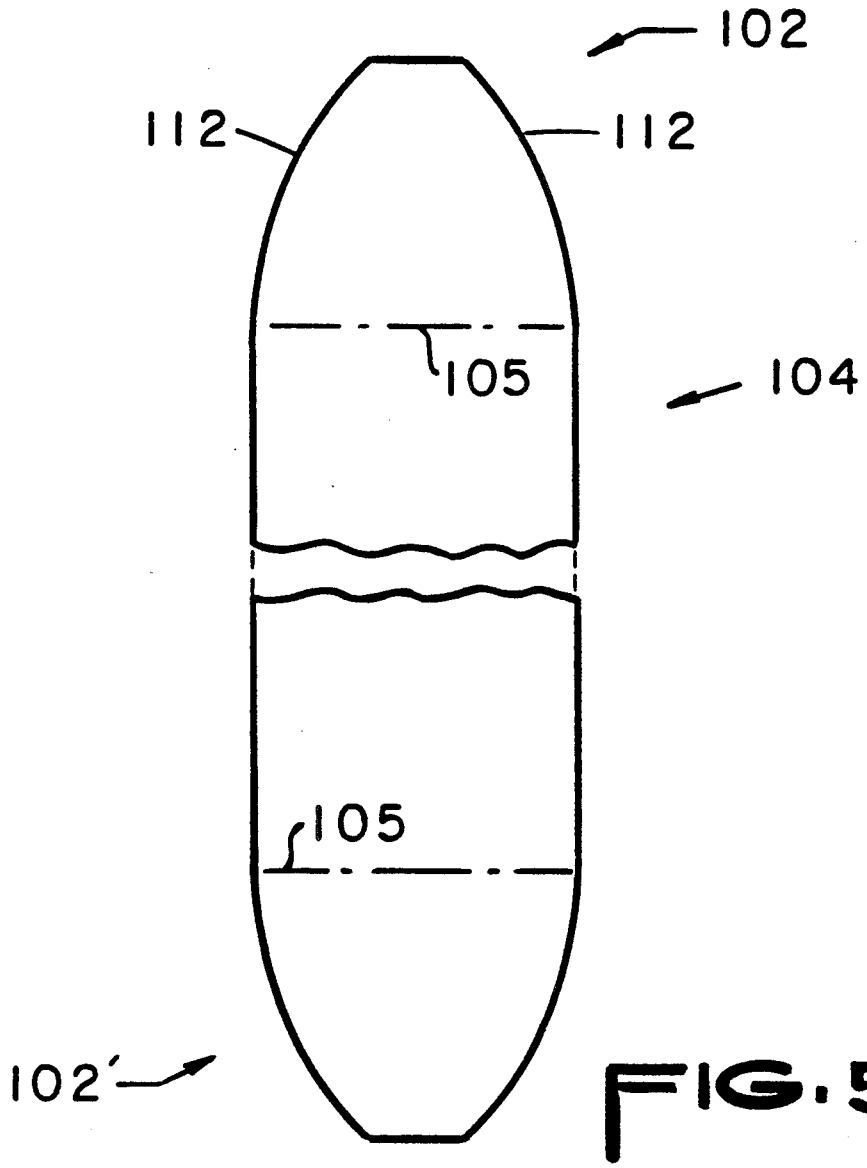
FIG. 5 is a side view of the electrical terminal pin having a pair of the electrical pin tips of FIGS. 3 and 4.

Referring to FIG. 3, there is illustrated an enlarged perspective view of a first embodiment of an electrical terminal pin tip 102 in accordance with the present invention. The pin tip 102 is on an end portion 103 of an electrical terminal pin 104 with a portion broken away to show a cross section 106 of the pin 104. The electrical terminal pin 104 is for inserting tip first into and electrically connecting to an electrical female terminal or a plated-through hole of a printed circuit board. FIG. 4 is a end view of the electrical terminal pin tip 102 of FIG. 3. FIG. 5 is a side view of the electrical terminal pin 104 having a pair of the electrical pin tips 102,102' of FIGS. 3 and 4.

Referring to FIGS. 3–5, the electrical terminal pin 104 comprises an electrically conductive core 108 and a conductive layer 110. The conductive layer 110 is plated on a perimeter of the core 108 at least near or immediately adjacent an end of the pin 104. The pin 104, the core 108 and the plating or layer 110 are symmetric about a longitudinal axis 107 of symmetry.

The pin tip 102 comprises a non-plated substantially flat end 116 of the core 108 and at least one curved side 112 substantially plated with the conductive layer 110. Preferably, the non-plated substantially flat end 116 is substantially perpendicular to the axis 107 of symmetry. Further, the non-plated substantially flat end 116 has at least one edge 118. In the embodiment illustrated in FIGS. 3–5, the non-plated substantially flat end 116 is substantially square with four edges 118. Since there is one curved side 112 corresponding to each edge 118, there are four curved sides 112. Each one of the curved sides 112 extends from a corresponding one of the substantially flat end edges 118 away from the longitudinal axis 107 to a perimeter 105 of the pin 104 near or immediately adjacent the pin tip 102. Preferably, the curved sides 112 are shaped substantially alike. The conductive layer 110 entirely covers each one of the curved sides 112 at least from the pin perimeter 107 to half way along the side 112 to the non-plated flat end 116. Preferably, each one of the curved sides 112 is a convex portion of a corresponding cylinder. It is also preferred that the plated curved sides 112 intersect the pin perimeter 105 at an angle tangent to the corresponding cylinder.

The pin 104 may further comprise a second pin tip 102' on another end of the pin 104 distal to the first tip 102. The second tip 102' can be a mirror image of the first tip 102. In other words, the second tip 102' can have the same shape as the first tip 102 but it can be rotated 180 degrees. Alternatively, the second pin tip 102' can be configured like any other tip described herein or elsewhere.

Figure 6:
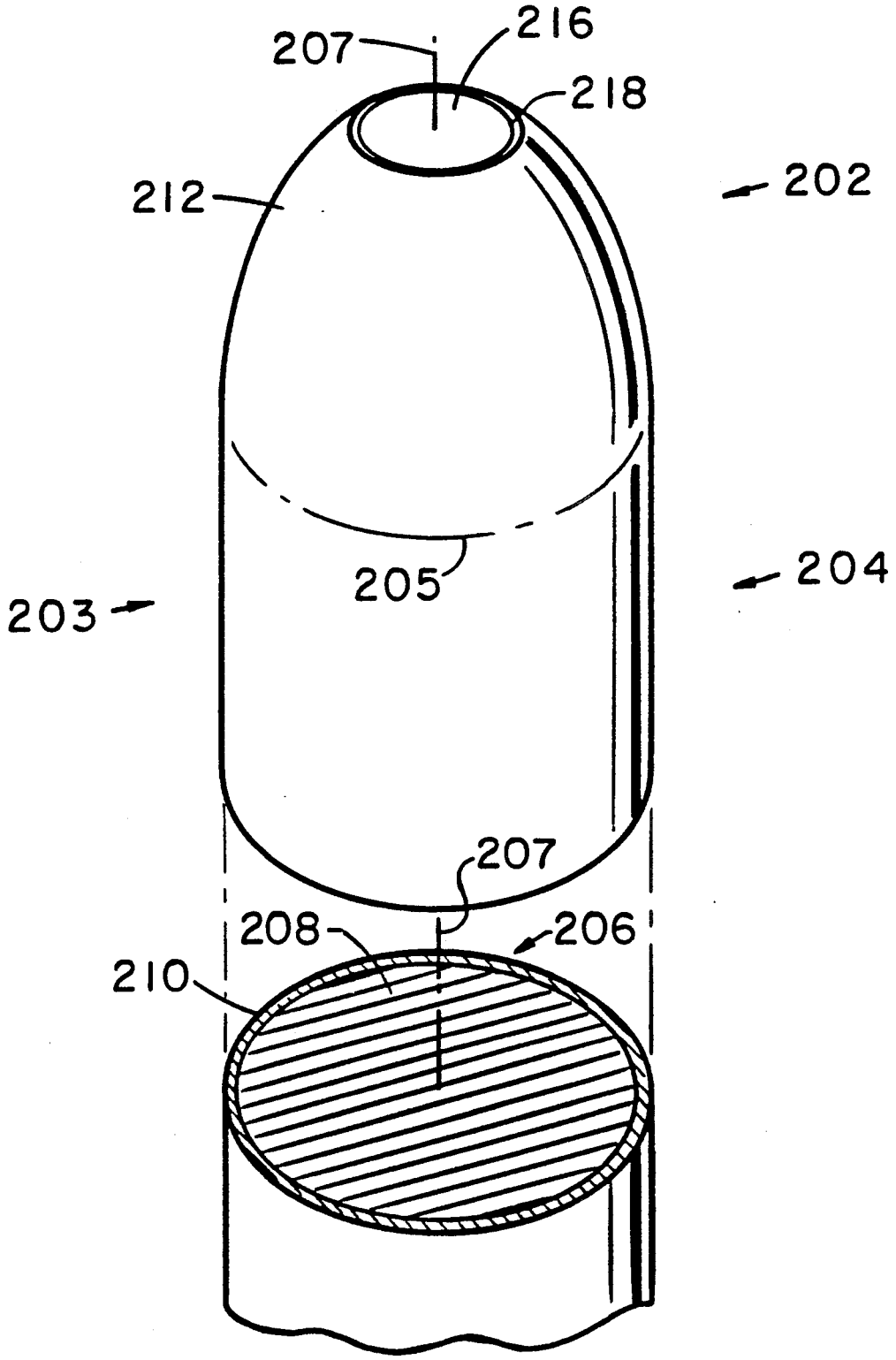
FIG. 6 is an enlarged perspective view of a second embodiment of an electrical terminal pin tip on an end portion of an electrical terminal pin with a portion broken away to show a cross section of the pin in accordance with the present invention.
Figure 7:
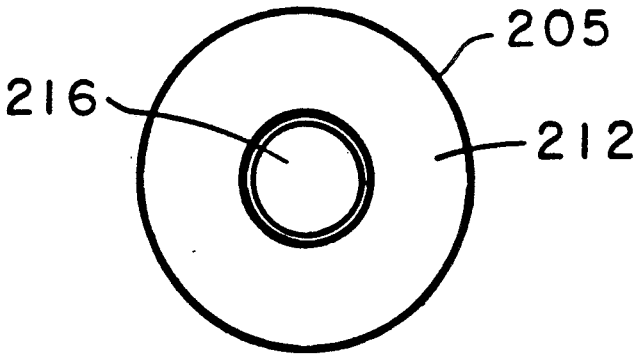
FIG. 7 is an end view of the electrical terminal pin tip of FIG. 6.
Figure 8:
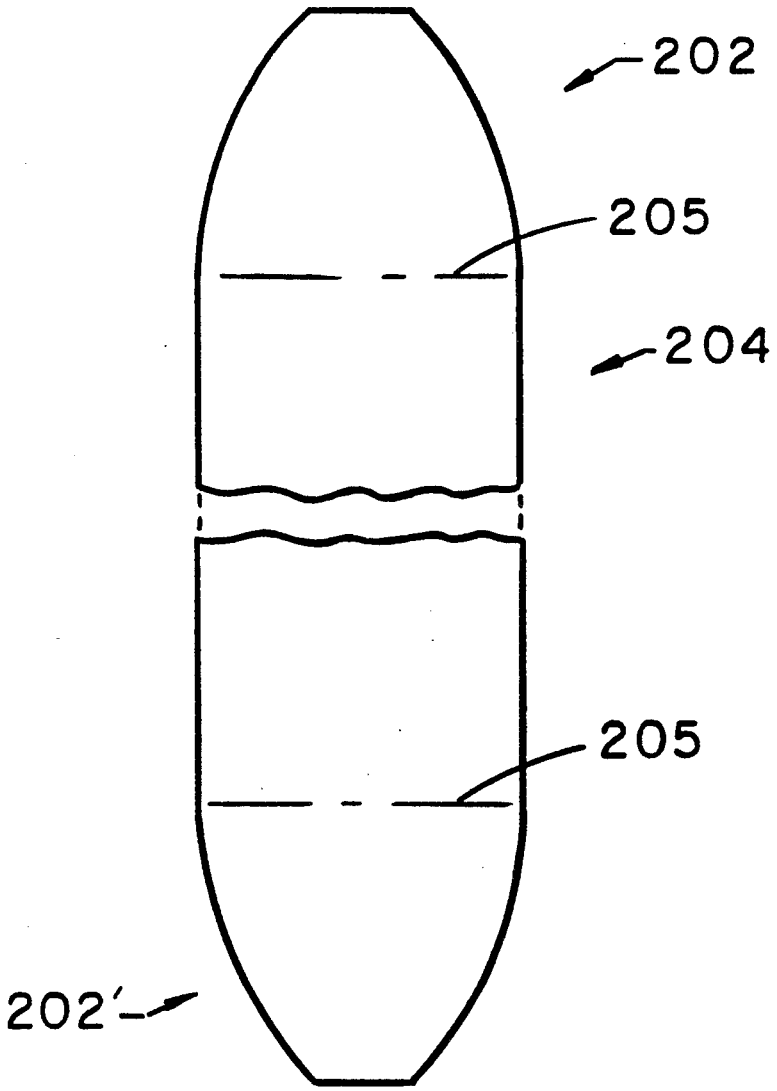
FIG. 8 is a side view of an electrical terminal pin having a pair of the electrical pin tips of FIGS. 6 and 7.

FIG. 6 is an enlarged perspective view of a second embodiment of an electrical terminal pin tip 202 on an end portion 203 of an electrical terminal pin 204 with a portion broken away to show a circular cross section 206 of the pin 204 in accordance with the present invention. The electrical terminal pin 204 comprises an electrically conductive core 208 plated with a conductive layer 210, both symmetric about a longitudinal axis 207. FIG. 7 is an end view of the electrical terminal pin tip 202 of FIG. 6. FIG. 8 is a side view of an electrical terminal pin 204 having a pair of the electrical pin tips 202,202' of FIGS. 6 and 7.

The second electrical terminal pin tip 202 is the same as the first electrical terminal pin tip 102, except the second electrical terminal pin tip 202 has a non-plated substantially flat end 216 which is substantially circular with only one circular edge 218. Further, it has only one curved side 212. The side 212 is convex and comprises a truncated sphere or ellipsoid. The second electrical terminal pin end portion 203 has a pin perimeter 205 near or immediately adjacent the pin tip 202 that is substantially circular.

Figure 9:
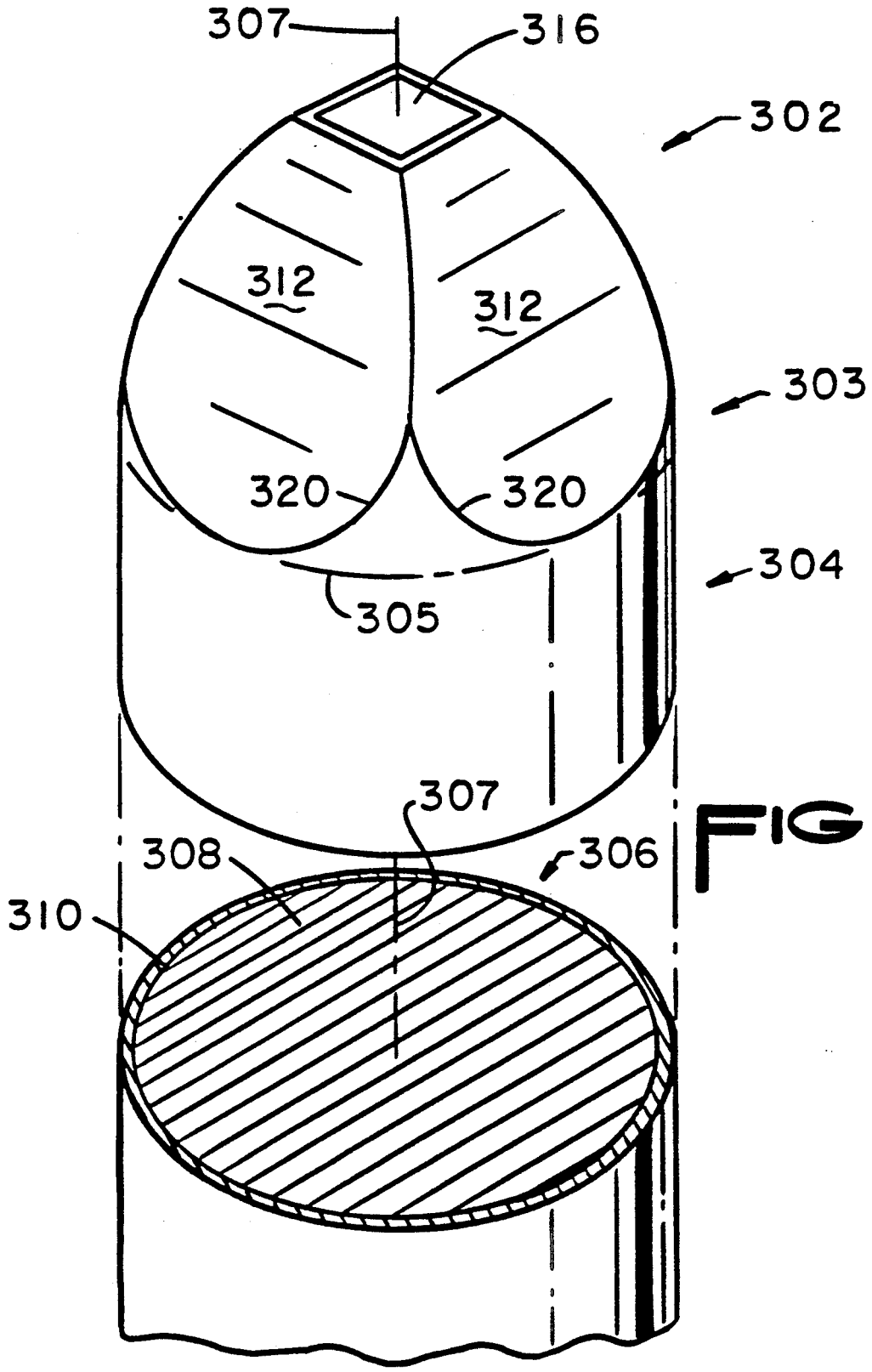
FIG. 9 is an enlarged perspective view of a third embodiment of an electrical terminal pin tip on an end portion of an electrical terminal pin with a portion broken away to show a cross section of the pin in accordance with the present invention.
Figure 10:
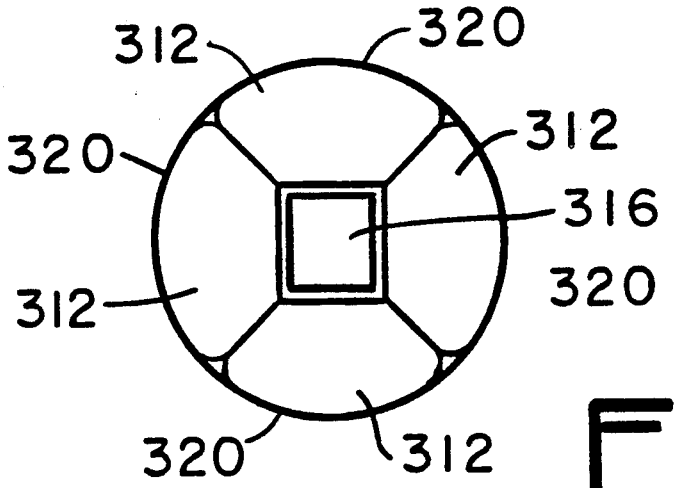
FIG. 10 is an end view of the electrical terminal pin tip of FIG. 9.
Figure 11:
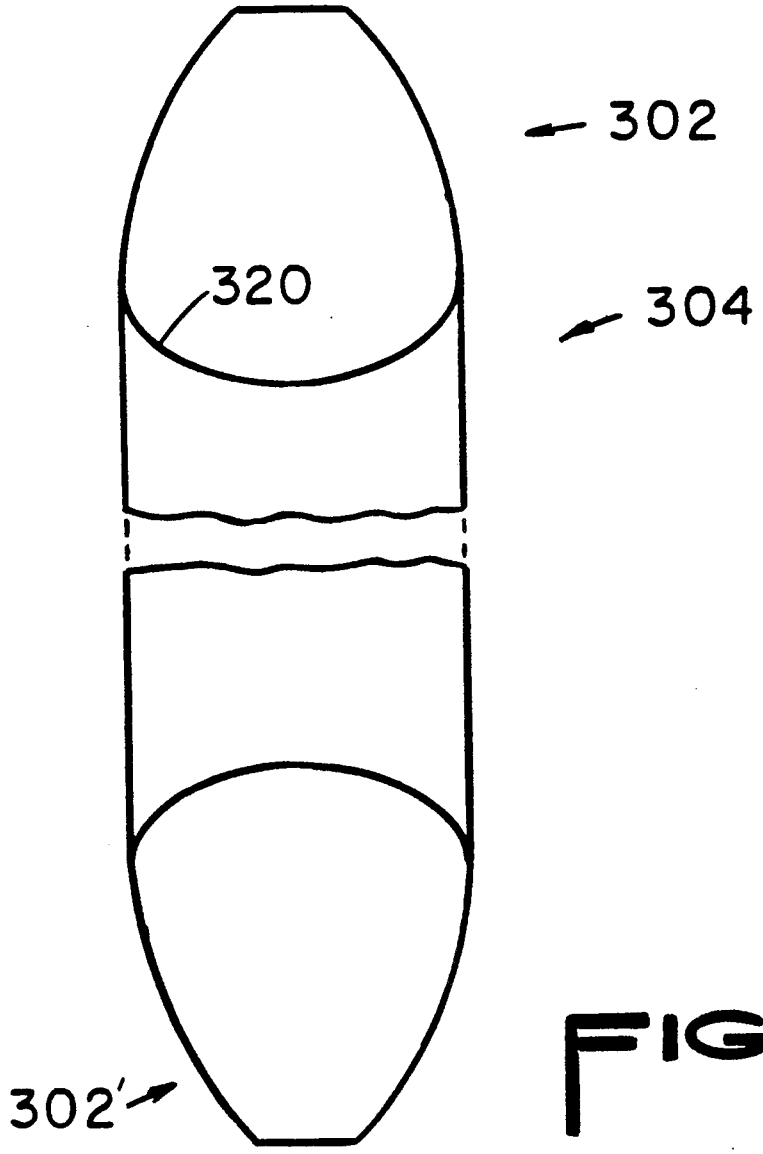
FIG. 11 is a side view of an electrical terminal pin having a pair of the electrical pin tips of FIGS. 9 and 10.

FIG. 9 is an enlarged perspective view of a third embodiment of an electrical terminal pin tip 302 on an end portion 303 of an electrical terminal pin 304 with a portion broken away to show a cross section 306 of the pin 304 in accordance with the present invention. The electrical terminal pin 304 comprises an electrically conductive core 308 plated with a conductive layer 310, both symmetric about a longitudinal axis 307. FIG. 10 is an end view of the electrical terminal pin tip 302 of FIG. 9. FIG. 11 is a side view of the electrical terminal pin 304 having a pair of the electrical pin tips 302,302' of FIGS. 9 and 10.

The third electrical terminal pin 304 has a first pin tip 302 connected to an electrical terminal pin end portion 303. The first pin tip 302 is the same as the first pin tip 102 illustrated in FIGS. 3–5, except where the first pin tip 302 joins the end portion 303. The pin end portion 303 is the same as the pin end portion 203 illustrated in FIGS. 6 and 8, except where the pin end portion 303 joins the pin tip 302. The electrical terminal pin tip 302 has a non-plated substantially flat end 316 which is substantially square. The electrical terminal pin tip 302 has four convex sides 312. The electrical terminal pin portion 303 has a pin perimeter 305 near or immediately adjacent the pin tip 302 that is substantially circular. The plated four convex sides 312 intersect the circular pin perimeter 305 at arced edges 320. Each end of the arced edges 320 intersects with an end of an adjacent one of the arced edges 320.

The electrical terminal pins 104,204,304 of the present invention can be made from any suitable metal used for electrical terminals, such as brass, phosphor bronze, beryllium copper and the like. The electrical terminal pins 104,204,304 may be plated or coated with any conductive layer 110,210,310, such as tin, nickel, pladium, gold, silver or a suitable alloy.

The electrical terminal pins 104,204,304 of the present invention can be made from a plated wire. The wire can be swaged around its perimeter forming a pair of the pin tips 102,202,302 at the same time connected together at their flat ends 116,216,316. Adjacent pins can be separated by applying opposing lateral forces on the pins or by twisting one with respect to the other.

Figure 2:
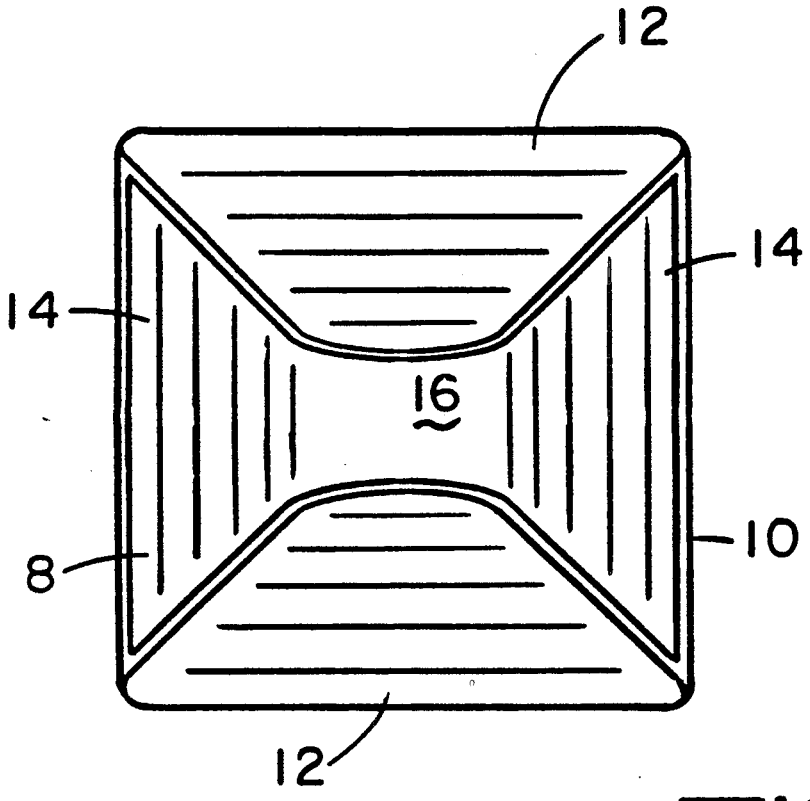
FIG. 2 PRIOR ART
FIG. 2 is an end view of the prior art electrical pin tip of FIG. 1.

The first, second and third electrical terminal pin tips 102,202,302, respectively, of the present invention have a greater mechanical advantage than the prior art tip 2 illustrated in FIGS. 1 and 2. This is the case because the slope of the sides 112,212,312 progressively decreases from the flat end 116,216,316 to the ends or arcs 320 of the sides 112,212,312 intersecting the perimeter 105,205,305. Thus, when the tip 102,202,302 is almost entirely inserted in the plated through hole or the mating female terminal, the slope of the side(s) 112,212,312 is providing a reduced longitudinal opposing force than the prior art pin 4 when the prior art pin 4 is inserted the same distance in the plated through hole or the mating female terminal. In other words, the longitudinal insertion force required to insert a pin with the first pin tip 102, the second pin tip 202 or the third pin tip 302, tip first into, for instance, a plated through hole or a mating female terminal, is less than the longitudinal insertion force required to insert the pin 4 illustrated in FIGS. 1 and 2 tip first. Further, the lateral retention force applied on the first pin 104, the second pin 204 or the third pin 304 by a plated through hole or a mating female terminal is the same or substantially the same as the lateral retention force applied on the pin 4 illustrated in FIGS. 1 and 2.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. An electrical terminal pin tip for inserting into an electrical female terminal or a plated-through hole of a printed circuit board, the pin tip comprising:

an electrically conductive layer; and an electrically conductive core with an axis of symmetry, the core having:

a non-plated substantially flat end having at least one edge; and at least one curved side substantially plated with the conductive layer, each one of the at least one curved side extending from a corresponding one of the at least one edge away from the axis of symmetry.

2. The electrical terminal pin tip of claim 1, wherein the non-plated substantially flat end is substantially square with four edges.

3. The electrical terminal pin tip of claim 1, wherein the non-plated substantially flat end is substantially circular with only one circular edge.

4. The electrical terminal pin tip of claim 1, wherein the non-plated substantially flat end is substantially perpendicular to the axis of symmetry.

5. The electrical terminal pin tip of claim 1, wherein the curved sides are shaped substantially alike.

6. The electrical terminal pin tip of claim 1, wherein the conductive layer entirely covers each one of the curved sides at least from a perimeter near the pin tip to half way along the side to the non-plated end.

7. The electrical terminal pin tip of claim 1, wherein there is only one curved side and the side comprises a sphere or truncated ellipsoid.

8. The electrical terminal pin tip of claim 1, wherein each one of the curved sides is a convex portion of a cylinder.

9. An electrical terminal pin end portion for inserting in and electrically connecting to an electrical female terminal or a plated-through hole of a printed circuit board, the pin end portion comprising:

an electrically conductive core with a longitudinal axis of symmetry and a perimeter about the longitudinal axis near an end of the pin end portion;

an electrically conductive layer plating the core perimeter; and a pin tip comprising:

a non-plated substantially flat end of the core, the end having at least one edge, and at least one curved side substantially plated with the conductive layer, each one of the at least one curved side extending from a corresponding one of the at least one edge away from the longitudinal axis to the perimeter.

10. The electrical terminal pin end portion of claim 9, wherein the core perimeter is substantially square and the non-plated substantially flat end is substantially square.

11. The electrical terminal pin end portion of claim 9, wherein the core perimeter is substantially circular and the non-plated substantially flat end is substantially circular.

12. The electrical terminal pin end portion of claim 9, wherein the core perimeter is substantially circular and the non-plated substantially flat end is substantially square.

13. The electrical terminal pin end portion of claim 9, wherein the substantially flat end is substantially perpendicular to the longitudinal axis.

14. The electrical terminal pin end portion of claim 9, wherein each one of the curved sides is a convex portion of a cylinder and the curved sides intersect the core perimeter at an angle tangent to the cylinder.

15. The electrical terminal pin tip end portion of claim 9, wherein there is only one curved side and the side comprises a truncated ellipsoid.

16. An electrical terminal pin for inserting in and electrically connecting to an electrical female terminal or a plated-through hole of a printed circuit board, the pin end portion comprising:

an electrically conductive core with a longitudinal axis of symmetry and a perimeter about the longitudinal axis near an end of the pin;

a conductive layer plating the core perimeter; and a first pin tip comprising:

a non-plated substantially flat end of the core, the end having at least one edge, and at least one curved side substantially plated with the conductive layer, each one of the at least one curved side extending from a corresponding one of the at least one end edge away from the longitudinal axis to the perimeter.

17. The electrical terminal pin of claim 16, further comprising a second pin tip comprising:

a non-plated substantially flat end of the core, the end having at least one edge, and at least one curved side substantially plated with the conductive layer, each one of the sides extending from a corresponding one of the flat end edges away from the longitudinal axis to the perimeter.

* * * * *